US007182214B2

(12) United States Patent
Darr et al.

(10) Patent No.: US 7,182,214 B2
(45) Date of Patent: Feb. 27, 2007

(54) PLASTIC CONTAINER INCLUDING AN UPPER GRIP PORTION

(75) Inventors: Richard C. Darr, Medina, OH (US); James C. Dorn, Norton, OH (US); Richard A. Lovelace, Jr., Akron, OH (US)

(73) Assignee: Plastipak Packaging, Inc., Plymouth, MI (US)

( * ) Notice: Subject to any disclaimer, the term of this patent is extended or adjusted under 35 U.S.C. 154(b) by 144 days.

(21) Appl. No.: 11/008,028

(22) Filed: Dec. 9, 2004

(65) Prior Publication Data

US 2006/0037930 A1 Feb. 23, 2006

Related U.S. Application Data

(63) Continuation-in-part of application No. 10/922,078, filed on Aug. 19, 2004, now abandoned.

(51) Int. Cl.
*B65D 23/10* (2006.01)

(52) U.S. Cl. ..... 215/398; 215/365; 215/382; 220/669; 220/675; 220/771; 40/310

(58) Field of Classification Search ..... 215/365, 215/382, 398, 265 K, 388, 379–381, 383, 215/384, 396, 900; 220/666, 669, 671, 675, 220/771; 40/310
See application file for complete search history.

(56) References Cited

U.S. PATENT DOCUMENTS 2,920,777 A * 1/1960 Cole ..... 215/380
3,308,997 A * 3/1967 Kelly ..... 222/475
4,541,529 A * 9/1985 Hestehave et al. ..... 206/510
4,579,260 A * 4/1986 Young et al. ..... 222/465.1
4,609,106 A * 9/1986 Gentili ..... 206/509
4,658,975 A * 4/1987 Cone ..... 215/385
4,804,119 A * 2/1989 Goodall ..... 222/468
4,889,261 A * 12/1989 Conrad ..... 222/130
4,923,098 A * 5/1990 Schoonover et al. ..... 222/465.1
4,928,860 A * 5/1990 Knight ..... 222/466
4,969,571 A * 11/1990 Bartz ..... 220/771
4,969,922 A * 11/1990 Platte, Sr. ..... 215/383
5,226,574 A * 7/1993 Durinzi, Jr. ..... 222/465.1
5,265,743 A * 11/1993 Frohn ..... 215/10
5,299,710 A * 4/1994 Welsch et al. ..... 220/675
5,350,078 A * 9/1994 Potts et al. ..... 215/384
D358,330 S * 5/1995 Kahl ..... D23/211.1
D377,604 S * 1/1997 Salmon et al. ..... D9/528
D387,277 S * 12/1997 Dixon et al. ..... D9/528

(Continued)

FOREIGN PATENT DOCUMENTS

EP 0457121 A1 * 11/1991

(Continued)

*Primary Examiner*—Sue A. Weaver
(74) *Attorney, Agent, or Firm*—Robert H. Bachman

(57) ABSTRACT

The container includes a hollow body of plastic material having a lower supporting base, a sidewall extending upwardly from the lower base, and an upper portion extending upwardly from the sidewall. The upper portion includes at least one opening therein. An integral handle is also provided at least in part on the sidewall. A grip portion, as a finger grip, is provided on the upper portion of the container spaced from the handle to provide stability when handling or when dispensing contents.

18 Claims, 7 Drawing Sheets

U.S. PATENT DOCUMENTS

D402,896 S * 12/1998 Conrad ..... D9/543
6,029,858 A * 2/2000 Srokose et al. ..... 222/143
D428,341 S * 7/2000 Boutin ..... D9/520
D429,644 S * 8/2000 Hughes ..... D9/528
D433,635 S * 11/2000 Chrisco et al. ..... D9/527
6,237,792 B1 * 5/2001 Skolnicki et al. ..... 215/382
6,305,564 B1 * 10/2001 Takeuchi et al. ..... 215/398
6,588,612 B1 * 7/2003 Dorn et al. ..... 215/10
2004/0007488 A1 * 1/2004 Soehnlen et al. ..... 206/431

FOREIGN PATENT DOCUMENTS

JP 04018246 A * 1/1992
JP 2002337880 A * 11/2002

* cited by examiner

PLASTIC CONTAINER INCLUDING AN UPPER GRIP PORTION

CROSS-REFERENCE TO RELATED APPLICATION

This application is a continuation-in-part of U.S. patent application Ser. No. 10/922,078, filed Aug. 19, 2004 now abandoned by Darr et al.

BACKGROUND OF THE INVENTION

Plastic containers, especially blow molded plastic containers in larger sizes, are frequently desired to be placed in coolers or refrigerators in different orientations. For example, it may be desirable to place the container upright, or it may be desirable to place the container on its side.

It is desirable to provide a plastic container that is readily suitable for such different orientations. The label panel should be suitable for such different orientations. Similarly, an integral handle should preferably be provided that is readily usable when the container is placed in such different orientations.

In addition, the plastic container as aforesaid should have a good wall structure suitable for hot filling without wall bulging and with good wall rigidity.

In addition to the foregoing, it is particularly desirable especially for large size containers to provide a means for stabilizing the container in addition to a handle when one dispenses contents therefrom.

Accordingly, it is a principal objective of the present invention to provide an improved plastic container suitable for placement in different orientations.

It is a further objective of the present invention to provide a plastic container as aforesaid with two label panels, one of which may be readily seen when the container is placed in different orientations.

It is a further objective of the present invention to provide a plastic container as aforesaid with a good wall structure suitable for hot filling without bulging.

It is a still further objective of the present invention to provide a container as aforesaid which provides a means for stabilizing the container in addition to a handle when one dispenses contents therefrom.

Further objects and advantages of the present invention will appear hereinbelow.

SUMMARY OF THE INVENTION

In accordance with the present invention the foregoing objects and advantages are readily obtained.

The plastic container of the present invention is desirably a blow molded plastic container and comprises: a hollow body of plastic material having a lower supporting base, a sidewall extending upwardly from the lower base, and an upper portion extending upwardly from the sidewall, said upper portion including at least one opening therein; an integral handle at least in part on the sidewall; and a grip portion on the upper portion and spaced from the handle. The grip portion is preferably a finger grip portion which can be held by one or more fingers of one hand to stablilize the container while the handle is held by the other hand to dispense contents.

The upper portion of the container desirably includes a raised area and a recessed area adjacent the raised area. The grip portion may include a flange portion extending outwardly from the raised area over the recessed area. A connecting member is provided at least in part extending downwardly from the raised area to the upper portion and over the recessed area to define an upper member of an enclosed grip portion.

Further features and advantages of the present invention will appear hereinbelow.

BRIEF DESCRIPTION OF THE DRAWINGS

The present invention will be more readily understandable from the accompanying drawings, wherein.

DETAILED DESCRIPTION OF PREFERRED EMBODIMENTS

Figure 1:
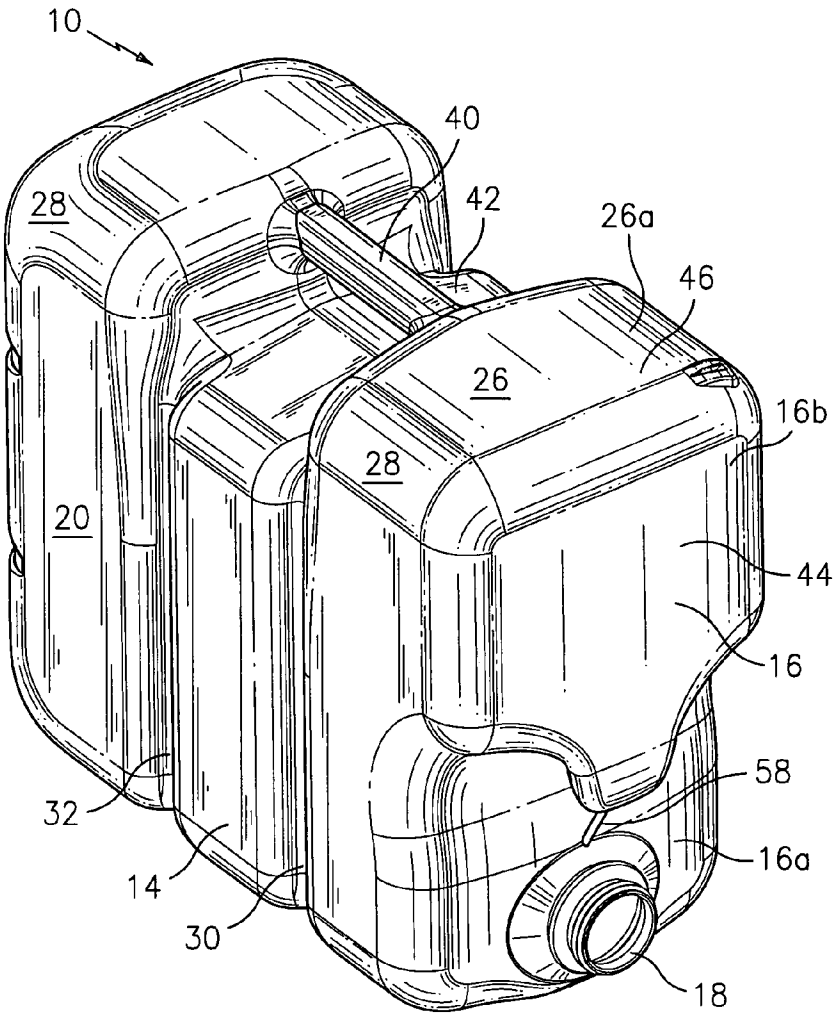
FIG. 1 is a perspective view of one embodiment of a container of the present invention showing the upper portion, rear sidewall portion with handle, and left sidewall portion.

FIGS. 1–6 show container 10 with a lower supporting base 12, sidewalls 14 extending upwardly from the lower base 12, and upper portion 16 extending upwardly from the sidewalls. In the embodiment of FIGS. 1–6, upper portion 16 includes a single opening 18 located on the front side 16*a* of upper portion 16; however, if desired one could provide more than one opening, as for example, a second opening on the rear side 16*b* of upper portion 16.

Container 10 includes opposed, relatively larger sidewall sections, namely left sidewall section 20 and right sidewall section 22, and opposed, relatively smaller sidewall sections, namely front sidewall section 24 and rear sidewall section 26. The larger sidewall sections 20, 22 alternate with the smaller sidewall sections 24,26. The container 10 has an essentially rectangular configuration with the four sidewall sections joined by rounded sidewall corners 28. Therefore, the larger sidewall sections are each joined to two smaller sidewall sections in an alternating large-small relationship.

The sidewalls 14 includes at least one and preferably more than one inwardly depressed channel. In the embodiment of FIGS. 1–6, two of these channels are shown, upper channel 30, and lower channel 32. The channels provide rigidity to the container and keep the container from bulging outwardly as during hot or cold filling, transportation and use. The exact number of channels will depend on the size and shape and contents of the container. In the embodiment of FIGS. 1–6, the rectangular container is a 2.5 gallon container. The depth and width of the channels will also depend on the size and use of the container. It is preferred that the container of the present invention have a capacity of at least one gallon and desirably at least two gallons.

Base 12 may also include at least one inwardly depressed channel, as base channels 34, which provide rigidity to the base of the container. Naturally, other base constructions can be provided.

Container 10 also includes an integral handle 40. In the embodiment of FIGS. 1–6 handle 40 is positioned inwardly of the rear sidewall 26 and has a generally straight configuration. Recessed area 42 is provided beneath the handle to allow easy grasping of the handle. The handle may if desired be curved or provided elsewhere on the container as for example extending from the upper side 26*a* of the rear sidewall section to the rear side 16*b* of upper portion 16.

Figure 2:
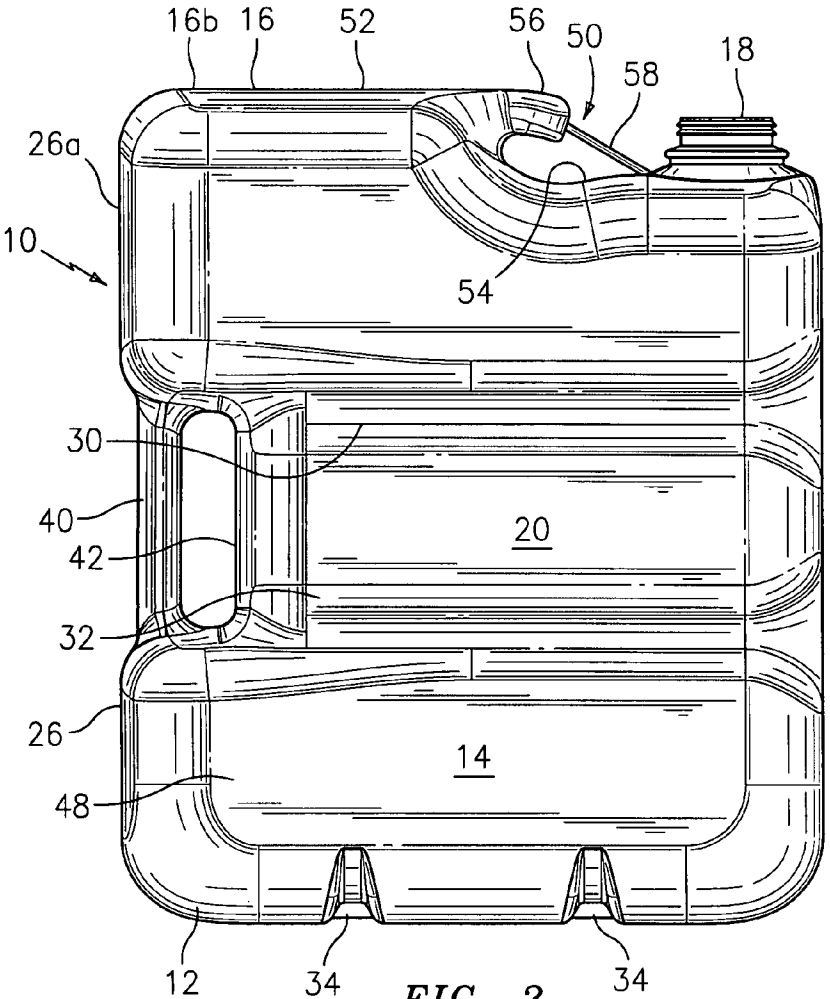
FIG. 2 is a left side elevation view of the container of FIG. 1.
Figure 4:
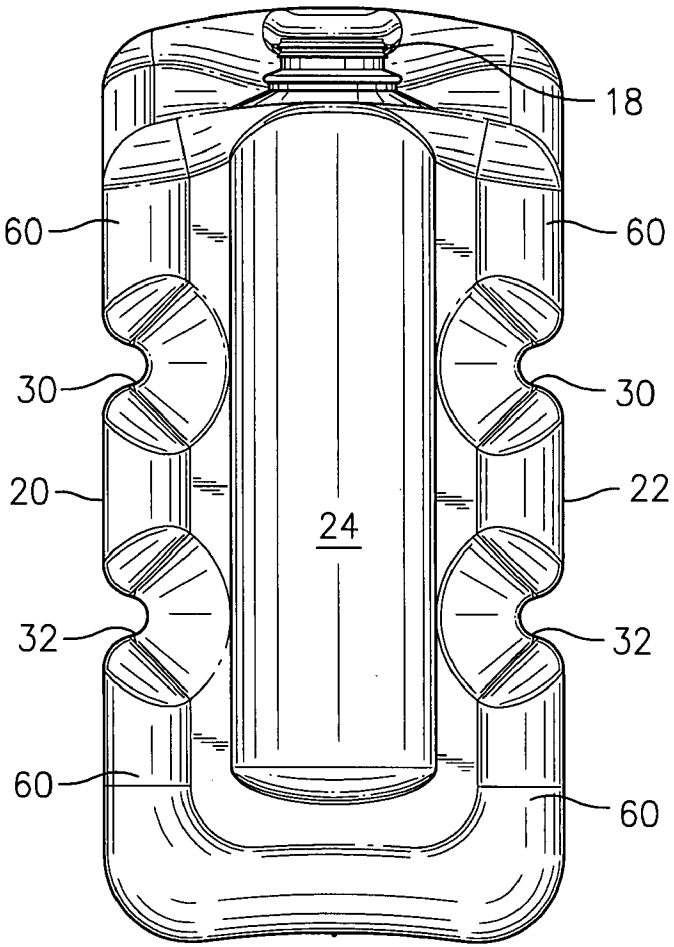
FIG. 4 is a front elevation view of the container of FIG. 1.
Figure 3:
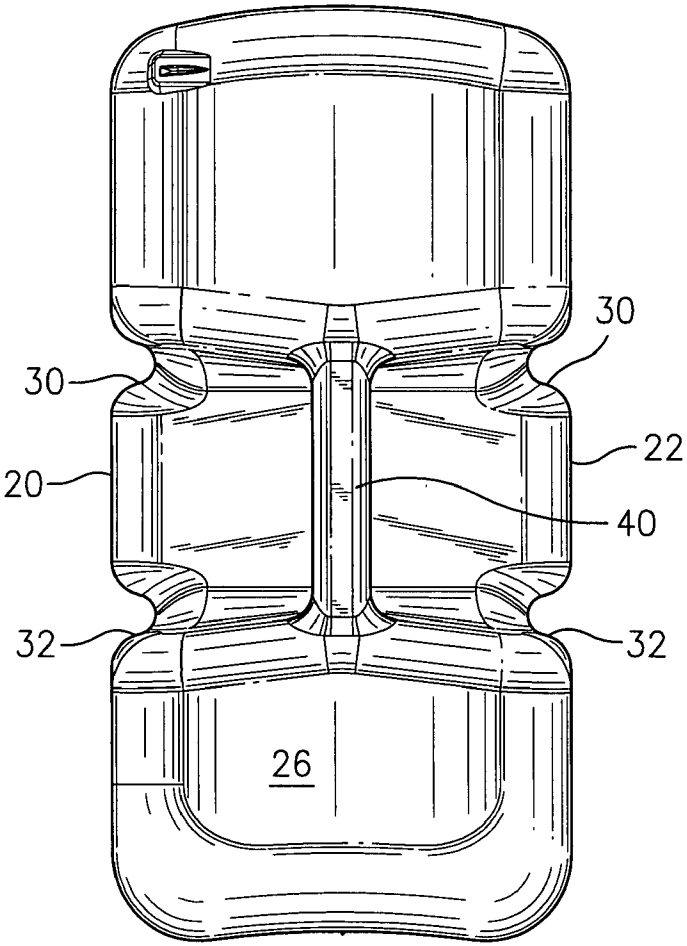
FIG. 3 is a rear elevation view of the container of FIG. 1.
Figure 6:
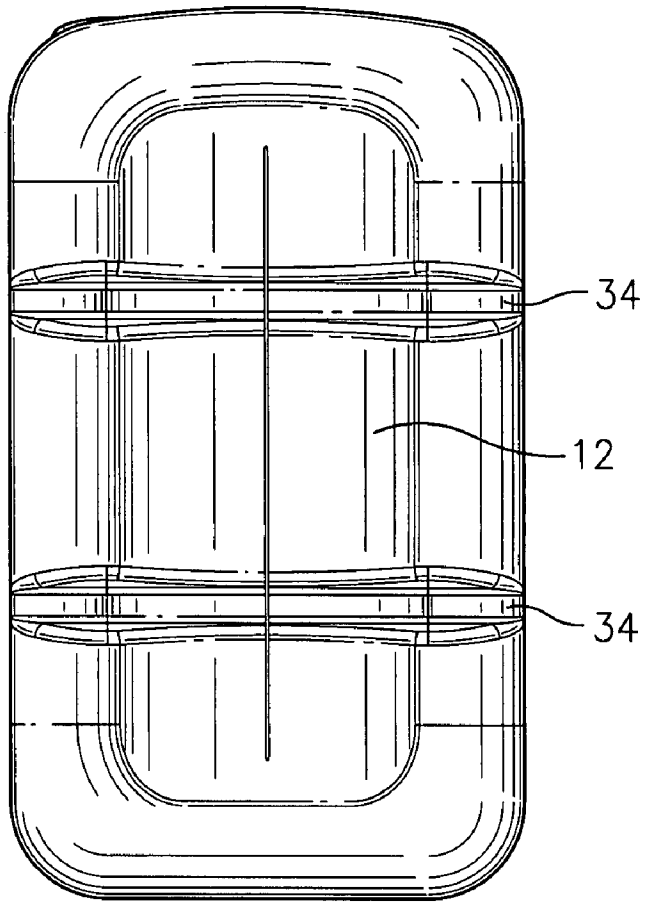
FIG. 6 is a bottom plan view of the container of FIG. 1.
Figure 5:
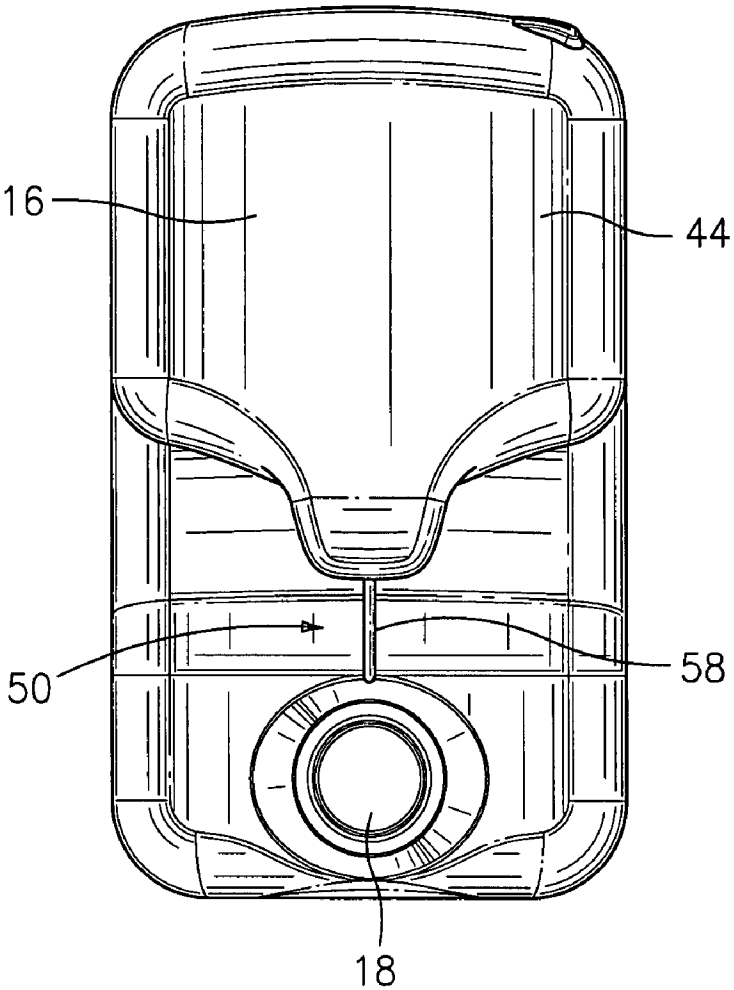
FIG. 5 is a top plan view of the container of FIG. 1.
Figure 7:
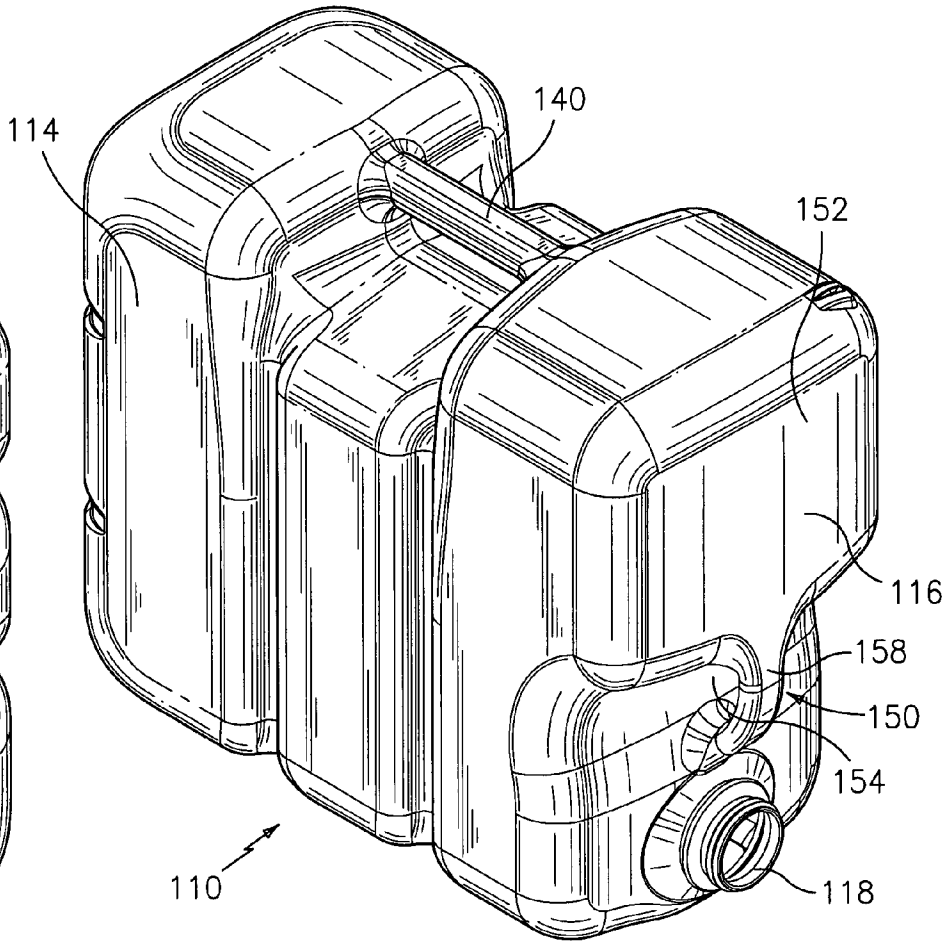
FIG. 7 is a perspective view of an alternate embodiment of a container of the present invention showing the upper portion, rear sidewall portion and left sidewall portion.
Figure 8:
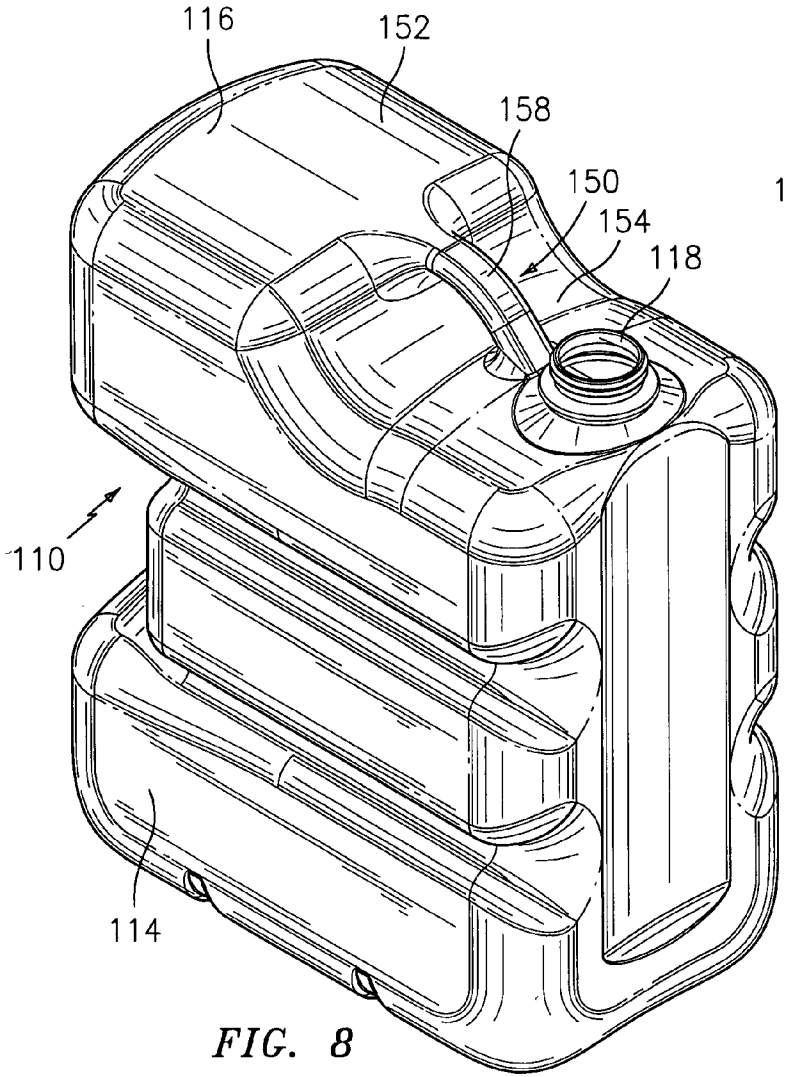
FIG. 8 is a perspective view of the container of FIG. 7 showing the upper portion, front sidewall portion and left sidewall portion thereof.
Figure 9:
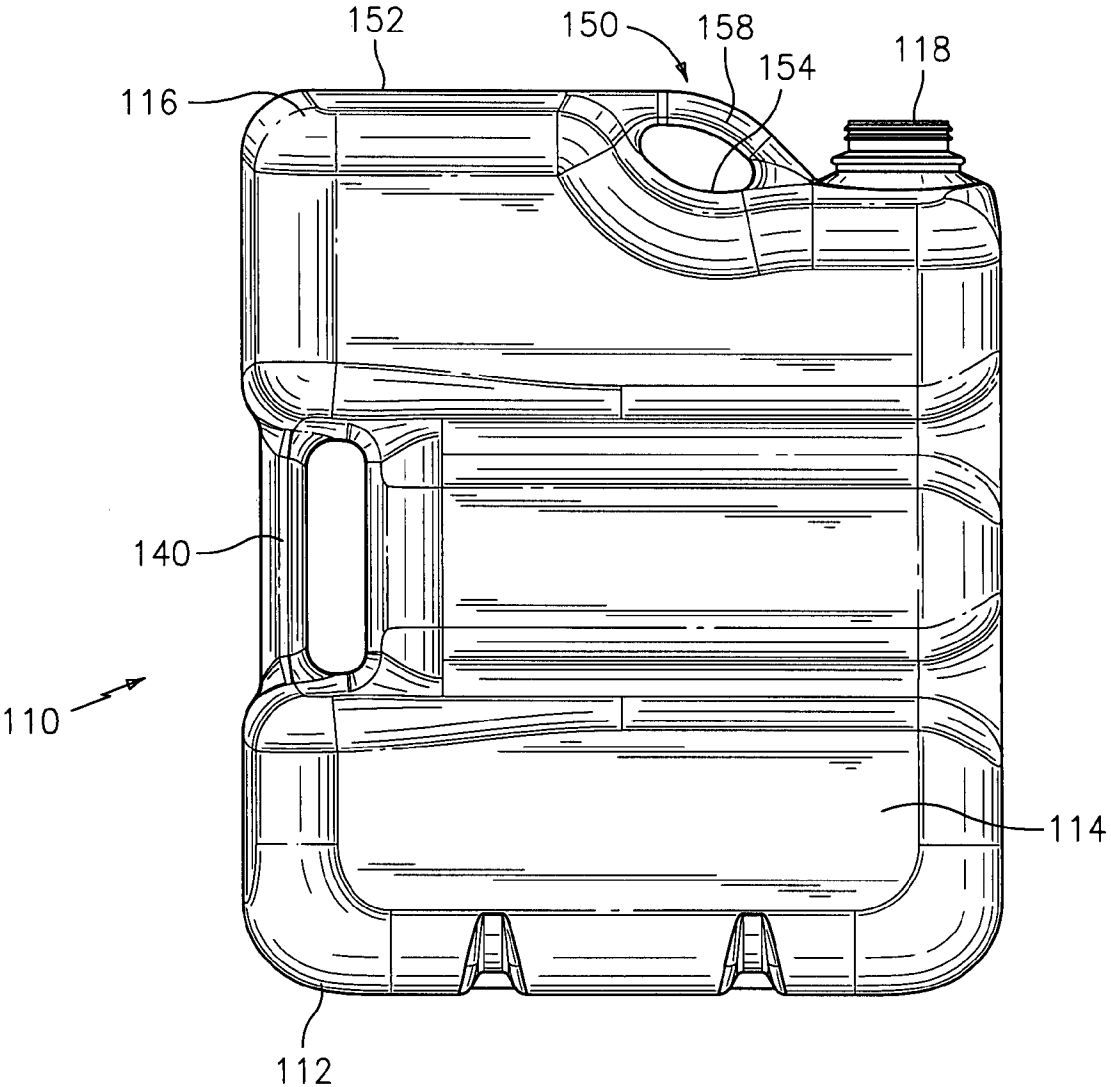
FIG. 9 is a left side elevation view of the container of FIG. 7.
Figure 11:
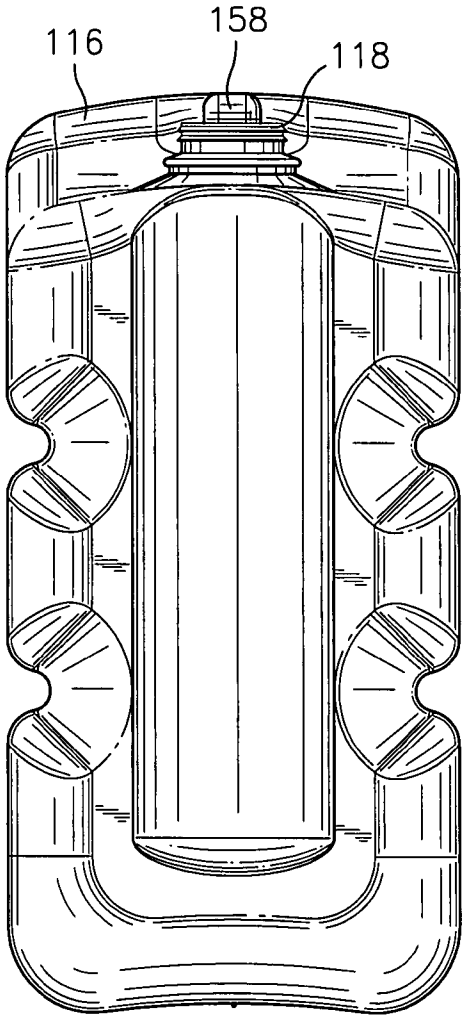
FIG. 11 is a front elevation view of the container of FIG. 7.
Figure 10:
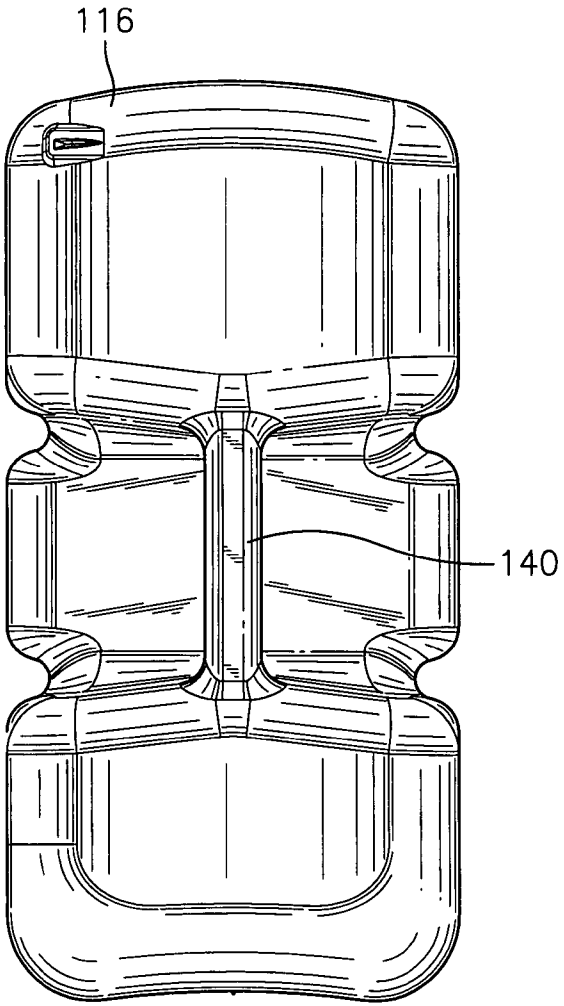
FIG. 10 is a rear elevation view of the container of FIG. 7.
Figure 13:
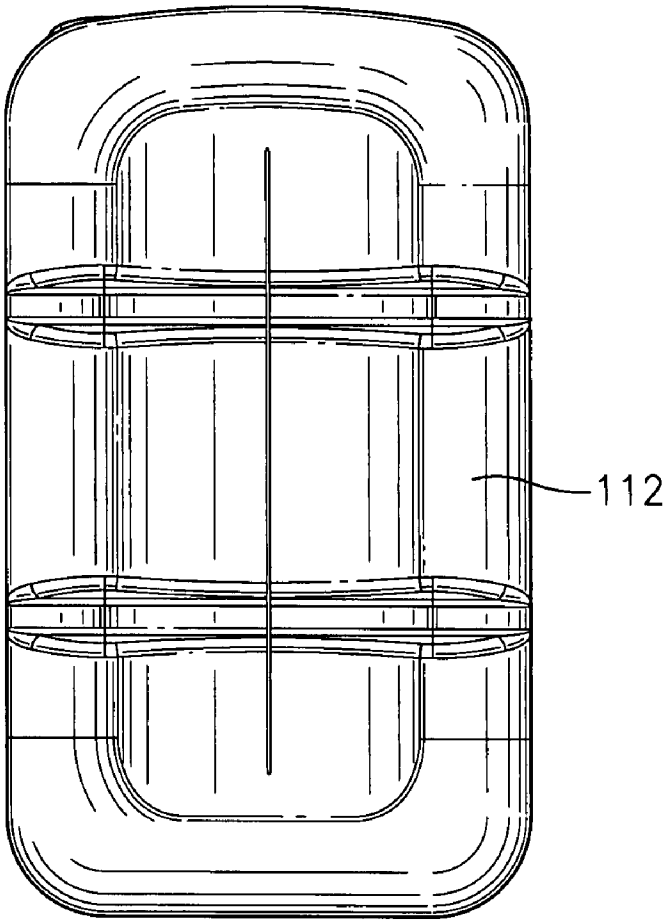
FIG. 13 is a bottom plan view of the container of FIG. 7.
Figure 12:
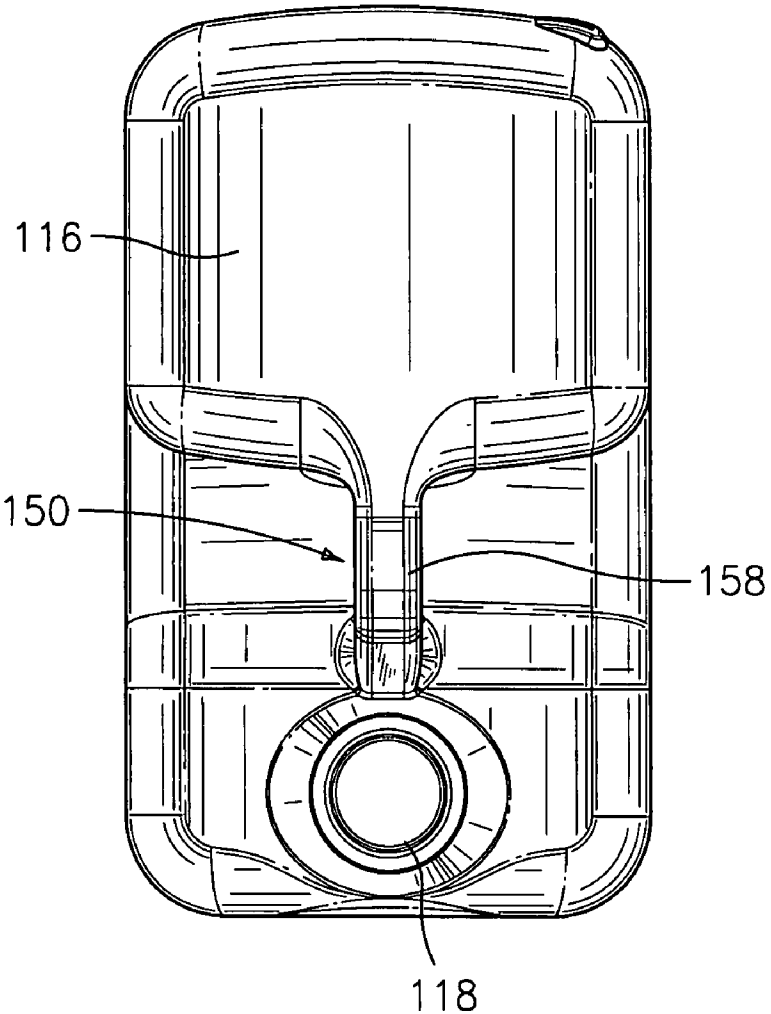
FIG. 12 is a top plan view of the container of FIG. 7.

Advantageously, container 10 includes at least two label panels, for example upper label panel 44 located on upper portion 16 and sidewall label panels 46 and 48 located on rear sidewall section 26 and left sidewall section 20, respectively. Naturally, other areas may also be used as label panels, if desired. Thus, a label can be applied to upper label panel 44 and also to at least one of the sidewall label panels 46, 48. This permits a label to be exposed when the container is in an upright orientation as shown in FIG. 2, or positioned on its side as shown in FIG. 1. In both of these configurations the handle would be easily accessible. At least one of the sidewall sections 20, 22, 24, 26 include relatively flat portions as flat portions 60 on sidewall section 24, so that the container may be supported on the flat portions as shown in FIG. 1. The relatively flat sidewall portions permits convenient storage in either the upright orientation or when the container is positioned on its side.

Naturally, other sidewall constructions can be used if desired in addition to the exemplificative embodiment shown.

Alternatively, one can attach or employ a dispensing head to the opening in the orientation of FIG. 1 and dispense directly from the container in the refrigerator.

The embodiment of FIGS. 1–6 shows the container with a 2.5 gallon capacity. It is preferred that the container of the present invention have a capacity of at least one gallon and desirably at least two gallons.

It is a particularly advantageous feature of the present invention that the container includes a grip portion 50 on upper portion 16 spaced from handle 40. This provides an effective means for stabilizing the container in addition to the handle when one dispenses contents therefrom, or when the container is moved from one location to another. This is particularly useful in the larger size containers.

Thus, one can hold the container by handle 40 with one hand and stabilize the container by holding grip portion 50 with one or more fingers of the other hand while dispensing contents.

As clearly shown in FIG. 2, the upper portion 16 of container 10 includes a raised area 52 with grip portion 50 extending over a recessed area 54 adjacent the raised area. The grip portion 50 includes a flange portion 56 extending outwardly from raised area 52 over recessed area 54. In addition, a connecting member 58, as a thin plastic member as shown in the embodiment of FIGS. 1–6, at least in part extends downwardly from flange portion 56 to upper portion 16 and over recessed area 54 to define an upper member of the grip portion. Thus, an enclosed grip portion 50 is formed which is easily and readily used to provide stability to the container. Naturally, other convenient configurations may be employed for the grip portion. For example, a wider connecting member may be employed and the flange portion may be eliminated or its configuration varied.

The alternate embodiment of FIGS. 7–13 show a container 110 similar in construction to the container of FIGS. 1–6, with a lower supporting base 112, sidewalls 114 extending upwardly from the lower base 112, and upper portion 116 extending upwardly from the sidewalls.

The essential difference between the two embodiments lies in the grip portion. Similar to the embodiment of FIGS. 1–6, grip portion 150 in the embodiment of FIGS. 7–13 on upper portion 116 is spaced from handle 140 to provide a comparable stabilizing means when contents are dispensed from the container. Also, the upper portion 116 of container 110 includes a raised area 152, with grip portion 150 extending over a recessed area 154 adjacent the raised area.

However, the grip portion 150 is a continuous connecting member 158 at least in part extending downwardly from raised area 152 and over recessed area 154 to upper portion 116 to form an upper member of an enclosed grip portion. The connecting member 158 extends between raised area 152 and the single container opening 118. In addition, in the embodiment of FIGS. 7–13, the connecting member is integrally formed with the container and is blow molded with the blow molding of the container to provide a wider, firmer grip portion, preferably one-half inch to one inch in width. Thus, a wider grip portion is provided which is integral with the container.

Thus, the container of the present invention offers considerable advantages. The at least two label panels are quite convenient in permitting storage of the container with easy label viewing in different orientations. Handle positioning permits easy access to the container and wall construction allows rigidity and freedom from undesirable bulging. The grip portion is particularly advantageous and provides stability in handling.

The container may be prepared from any desired plastic material, such as polyethylene, polyethylene terephthalate, polypropylene, or any other desired plastic. Preferably a high strength plastic material is used for the larger size containers, such as high density polyethylene.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A plastic container, which comprises:

a hollow body of plastic material having a lower supporting base, a sidewall extending upwardly from the lower base and an upper portion extending upwardly from the sidewall, said upper portion including at least one opening therein;

an integral handle at least in part on the sidewall; and a grip portion on the upper portion and spaced from the handle, wherein said upper portion includes a raised area and a recessed area, wherein said grip portion extends over said recessed area and extending downwardly from said raised area to said recessed area adjacent said opening, said container including at least two label panels, one on the upper portion and one on the sidewall.

2. A container according to claim 1, wherein said grip portion is a finger grip portion.

3. A container according to claim 2, wherein said grip portion is a narrow, web-like member which extends continuously downwardly.

4. A container according to claim 1, wherein said grip portion includes a flange portion extending outwardly from said raised area over said recessed area between the raised area and grip portion.

5. A container according to claim 4, wherein said grip portion extends downwardly from said flange portion to said upper portion and over said recessed area.

6. A container according to claim 1, wherein at least one of the sidewall and base includes at least one inwardly depressed channel.

7. A container according to claim 6, including at least two of said channels spaced from each other.

8. A container according to claim 1, wherein said container has a capacity of at least one gallon.

9. A container according to claim 1, wherein said container sidewall has an essentially rectangular configuration, with two opposed relatively larger sidewall sections which alternate with two opposed relatively smaller sidewall sections.

10. A container according to claim 9, wherein at least one sidewall section includes relatively flat portions so that the container may be supported on said flat sidewall portions.

11. A container according to claim 10, wherein the sidewall sections are connected by rounded corners.

12. A container according to claim 9, wherein the handle is located generally centrally on a relatively smaller sidewall section.

13. A container according to claim 1, wherein said container is a blow molded plastic container.

14. A container according to claim 1, wherein said container and grip portion are blow molded.

15. A container according to claim 1, wherein at least a portion of the grip portion has a width of one-half inch to one inch.

16. A container according to claim 1, with an open, pass-through portion beneath said grip portion.

17. A container according to claim 1, wherein said handle is positioned inwardly of the sidewall.

18. A plastic container which comprises:

a hollow body of plastic material having a lower supporting base, a sidewall extending upwardly from the lower base and an upper portion extending upwardly from the sidewall, said upper portion including at least one opening therein;

an integral handle at least in part on the sidewall; and a grip portion on the upper portion and spaced from the handle, wherein said upper portion includes a raised area and a recessed area, wherein said grip portion is a narrow web-like member which extends over said recessed area and extends continuously downwardly from said raised area to said recessed area.

* * * * *